United States Patent [19]

Hoshino

[11] 4,422,292

[45] Dec. 27, 1983

[54] CLOSED CYCLE IN-LINE DOUBLE-ACTING HOT GAS ENGINE

[75] Inventor: Yasunari Hoshino, Yokohama, Japan

[73] Assignee: Nissan Motor Company, Limited, Yokohama, Japan

[21] Appl. No.: 271,124

[22] Filed: Jun. 8, 1981

[30] Foreign Application Priority Data

| | | | |
|---|---|---|---|
| Jun. 9, 1980 | [JP] | Japan | 55-76624 |
| Jun. 30, 1980 | [JP] | Japan | 55-87719 |
| Sep. 5, 1980 | [JP] | Japan | 55-122344 |

[51] Int. Cl.[3] ..... F02G 1/04

[52] U.S. Cl. ..... 60/525

[58] Field of Search ..... 60/525

[56] References Cited

U.S. PATENT DOCUMENTS

| | | | |
|---|---|---|---|
| 2,480,525 | 8/1949 | Van Weenen | 60/525 |
| 2,611,235 | 9/1952 | Van Weenen | 60/525 |
| 2,644,699 | 1/1954 | Kohler | 60/525 |
| 2,817,950 | 12/1957 | Van Weenen et al. | 60/525 |
| 3,795,102 | 3/1974 | Tusche | 60/525 |
| 3,820,331 | 6/1974 | Reuchlein | 60/525 |
| 3,845,626 | 11/1974 | Berntell et al. | 60/525 |

FOREIGN PATENT DOCUMENTS

| | | |
|---|---|---|
| 2402289 | 7/1975 | Fed. Rep. of Germany . |
| 2940207 | 4/1980 | Fed. Rep. of Germany . |

OTHER PUBLICATIONS

Motortechnische Zeitschrift, vol. 38, No. 9, Sep. 1977 by F. Zacharias "Weiterentwicklungen am Stirlingmotor–Teil 1", pp. 371 to 374, 377.

*Primary Examiner*—Allen M. Ostrager

*Attorney, Agent, or Firm*—Schwartz, Jeffery, Schwaab, Mack, Blumenthal & Koch

[57] ABSTRACT

A closed cycle in-line double-acting hot gas engine designed such that an ordinary crankshaft can be used without the need of special jigs and tools. The hot gas engine according to the present invention has regenerator/coolers which are each arranged around the respective cylinders concentrically and cylindrically with respect to the cylinders and four pairs of approximately quadrant-shaped manifolds arranged over the engine so as to form a heat exchanger with the respective heaters gathered in cylindrical shape.

7 Claims, 30 Drawing Figures

CLOSED CYCLE IN-LINE DOUBLE-ACTING HOT GAS ENGINE

BACKGROUND OF THE INVENTION

1. Field of the Invention

The present invention relates generally to a closed cycle in-line double-acting hot gas engine, and more specifically to the construction of a closed cycle in-line double-acting hot gas engine in which an ordinary crankshaft can be used without special jigs and tools, vibration is reduced by evening the outputs generated from the respective cylinders, and a higher performance can be obtained in spite of a relatively simple construction.

2. Description of the Prior Art

This type of engine is a closed cycle hot gas engine in which a gas such as $H_2$, He, $N_2$ or the like is hermetically sealed under a high pressure and power is generated by heating and cooling the gas repeatedly from the outside of the engine, that is, by utilizing the force generated by the expansion and compression of the gas.

When this hot gas engine is embodied as a double-acting engine, four cylinders are considered to be proper from the standpoint of its power, efficiency and structure.

The feature of this hot gas engine is that the expansion spaces provided over the pistons are connected to the compression spaces under the next pistons through the respective heaters, and the respective regenerator/-coolers.

In the closed cycle double-acting hot gas engine thus constructed, since it is desirable to arrange the cylinders and hot exchangers so as to form the respective uniform working spaces, the cylinders are generally arranged in a circle.

In such a double-acting hot gas engine, however, a special structure is required to convert reciprocating force to rotational force, since an ordinary crankshaft used in an ordinary engine cannot be used.

For instance, a swash plate is used in engines designed by N. V. Philips' Gloeilampenfabriken, and a single crankshaft V-type engine or a double crankshaft U-type engine is used by KB United Stirling (Sweden) AB & CO.

These structures are skilfully designed for the multiple-cylinder hot gas engine; however, since the structures are very complicated compared to the ordinary crankshaft system for an in-line engine, special tools or jigs and skilful assembly are required when these engines are mass-produced for an automotive vehicle, and therefore there has been a problem that these hot gas engines are costly.

A more detailed description of the prior-art closed cycle in-line double-acting hot gas engine will be made hereinafter with reference to the accompanying drawings under DETAILED DESCRIPTION OF THE PREFERRED EMBODIMENTS.

SUMMARY OF THE INVENTION

With these problems in mind therefore, it is the primary object of the present invention to provide a closed cycle in-line double-acting hot gas engine so arranged that the engine operates in the same order as in the ordinary in-line engine, all the lengths of the gas passageways between the cooler ends and the respective compression spaces of the cylinders are the same without increasing the dead volumes in the respective low-temperature portions, and the respective outputs from the cylinders are also the same, using a relatively simple structure.

To achieve the above-mentioned object, in the closed cycle in-line double-acting hot gas engine according to the present invention, the first regenerator/cooler and the third regenerator/cooler are arranged on one side of the cylinder line, and the second regenerator/cooler and the fourth regenerator/cooler are arranged on the other side; four pairs of approximately quadrant-shaped manifolds are arranged vertically and symmetrically over the engine so as to form a single cylindrical heat exchanger, and the four pairs of manifolds are connected to each other by a plurality of inverted U-shaped hot tubes; and the respective regenerator/coolers are formed around the respective cylinders concentrically and cylindrically with respect to said cylinders so as to eliminate the low-temperature ducts.

BRIEF DESCRIPTION OF THE DRAWINGS

The features and advantages of the in-line hot engine according to the present invention will be more clearly appreciated from the following description taken in conjunction with the accompanying drawings in which like reference numerals designate corresponding elements and in which:

FIG. 9(B) is a diagrammatic side view of FIG. 9(A), in which FIG. 9B is a fragmentary cross-sectional view of a heater tube taken along the lines C—C' in FIG. 9(A);

DETAILED DESCRIPTION OF THE PREFERRED EMBODIMENTS

To facilitate understanding of the present invention, a brief reference will be made to a prior-art closed cycle multiple cylinder double-acting hot gas engine.

Figure 1:
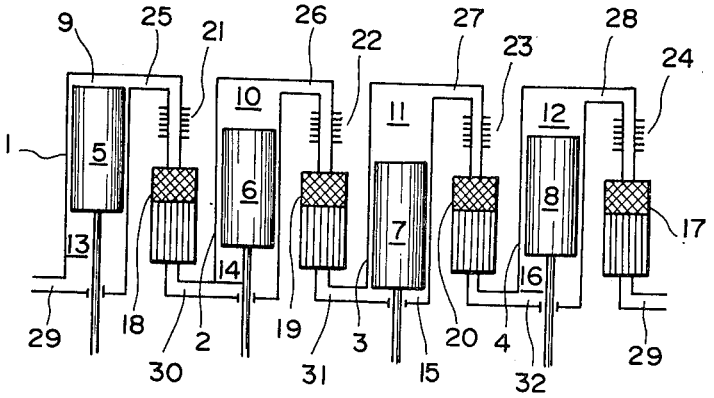
FIG. 1 PRIOR ART
FIG. 1 is a diagrammatic side view showing the working spaces of an in-line four-cylinder double-acting hot gas engine.

FIG. 1 shows a diagram of assistance in explaining the operation of a four-cylinder closed cycle double-acting hot gas engine. In this figure, the reference numerals 1, 2, 3 and 4 denote a first cylinder, a second cylinder, a third cylinder and a fourth cylinder respectively; the numerals 5, 6, 7 and 8 denote a first piston, a second piston, a third piston, and a fourth piston respectively; the numerals 9, 10, 11 and 12 denote a first expansion space, a second expansion space, a third expansion space, and a fourth expansion space, respectively; the numerals 13, 14, 15 and 16 denote a first compression space, a second compression space, a third compression space, and a fourth compression space, respectively; the numerals 21, 22, 23 and 24 denote a first heater, a second heater, a third heater and a fourth heater, respectively; the numerals 17, 18, 19 and 20 denote a first regenerator/cooler, a second regenerator/cooler, a third regenerator/cooler and a fourth regenerator/cooler, respectively; the numerals 25, 26, 27 and 28 denote a first high temperature duct, a second high temperature duct, a third high temperature duct, and a fourth high temperature duct, respectively; and the numerals 29, 30, 31 and 32 denote a first low temperature duct, a second low temperature duct, a third low temperature duct, and a fourth low temperature duct, respectively.

The respective heaters 21, 22, 23 and 24, regenerator/coolers 17, 18, 19 and 20, high temperature ducts 25, 26, 27 and 28, and low temperature ducts 29, 30, 31 and 32 are each disposed between two cylinders.

The primary feature of this hot gas engine is that each expansion space provided over each piston is connected to the next compression space under the next piston through the respective heater, and the next regenerators/cooler.

For instance, the first expansion space 9 of the first cylinder 1 is connected to the second compression space 14 of the second cylinder 2 through the first heater 21 and the second regenerator/cooler 18.

In this embodiment of a four-cylinder engine, the pistons operate in the order of the first cylinder 1, the second cylinder 2, the third cylinder 3, and the fourth cylinder 4 with a constant phase shift of 90 degrees in crankshaft angle.

Figure 2:
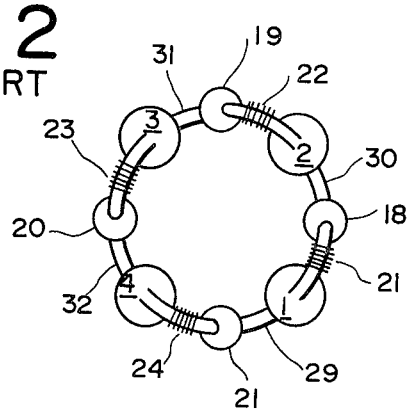
FIG. 2 PRIOR ART
FIG. 2 is a diagrammatic top view showing a typical prior-art four-cylinder double-acting hot gas engine in which the cylinders and heat exchangers are arranged in a circle.

In the multiple cylinder double-acting hot gas engine thus constructed, since it is desirable to arrange the cylinders and heat exchangers so as to form uniform working spaces, the cylinders 1, 2, 3 and 4 are generally arranged in a circle, as depicted in FIG. 2.

In such a double-acting hot gas engine, however, a special structure is required to convert the reciprocating force into a rotational force, since it is not possible to use an ordinary crankshaft used in an ordinary engine.

For instance, a swash plate is used in the engines of Philips, and a single crankshaft V-type engine or a double crankshaft U-type engine is used by the United Stirling.

These structures are skilfully designed in these multiple-cylinder hot gas engines; however, since the structures are very complicated compared to the ordinary crankshaft system in an in-line engine, special tools and jigs and skilful assembly is required when these engines are mass-produced for an automotive vehicle, and therefore there has been a problem that these hot gas engines are costly.

Figure 3:
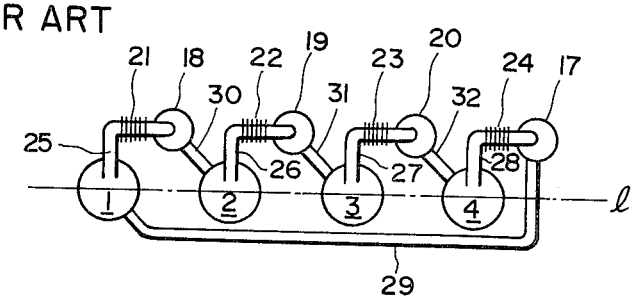
FIG. 3 PRIOR ART
FIG. 3 is a diagrammatic top view showing a typical prior-art in-line four-cylinder double-acting hot engine in which the engine is operated in the order of the first, second, third, and fourth cylinders.

To overcome this problem, the cylinders are arranged in a straight line as depicted in FIG. 3; however, it may be impossible to operate the hot gas engine efficiently using such a simple in-line arrangement. To explain in more detail with reference to FIG. 3, although the same working spaces can be obtained from the high temperature portion of the first cylinder 1 to the low temperature portion of the fourth cylinder 4, the gas passageway from the fourth cylinder to the first cylinder is much longer than the other gas passageways. That is, in this figure, the first low temperature duct 29 is much longer than the other low temperature ducts 30, 31 and 32 and therefore the output of cylinder 4 is not equal to the outputs of the other cylinders since there are differences between cylinder 4 and the other cylinders 1, 2 and 3 in pressure loss or dead volume.

In addition, vibration will be generated since the engine operates in the order of the first, the second, the third and the fourth cylinders 1, 2, 3 and 4 respectively.

To overcome this problem, MAN/MWM in West Germany constructs an engine which operates in the order of the first, the third, the fourth and the second cylinders; however, there are other problems with these engines. For example, the lengths of the low temperature ducts are not uniform and are relatively long, and additionally three burners for the heaters are required for a four-cylinder engine.

It is the primary object of the present invention to provide a multiple-cylinder hot gas engine such that the engine is operated in the order of the first, the third, the fourth and the second cylinders in the same way as in the ordinary in-line four-cylinder engine, without increasing the dead volumes on the low temperature sides.

In the double-acting hot gas engine thus constructed, since working spaces are provided above and below the respective pistons, the output is twice that of a single-acting hot gas engine or a displacer-type hot gas engine, and therefore an engine of this type is suitable in the case where a small-sized engine is required for an automotive engine.

Therefore, it is another object of the present invention to provide a multiple cylinder hot gas engine so constructed as to be smaller in size and higher in efficiency.

Figure 4:
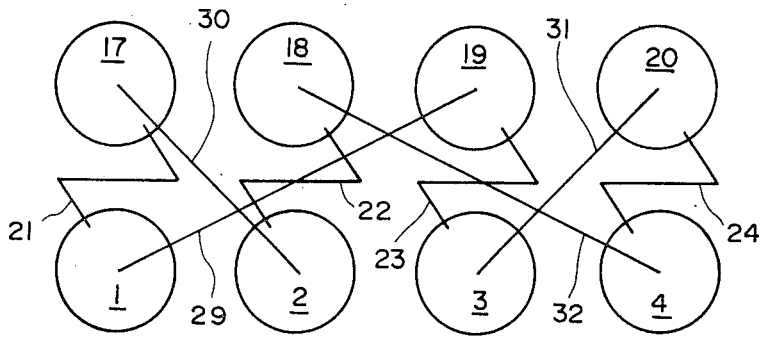
FIG. 4 PRIOR ART
FIG. 4 is a diagrammatic top view showing a typical prior-art in-line four-cylinder double-acting hot engine in which the regenerator/coolers are arranged in parallel with the respective in-line cylinders.
Figure 5:
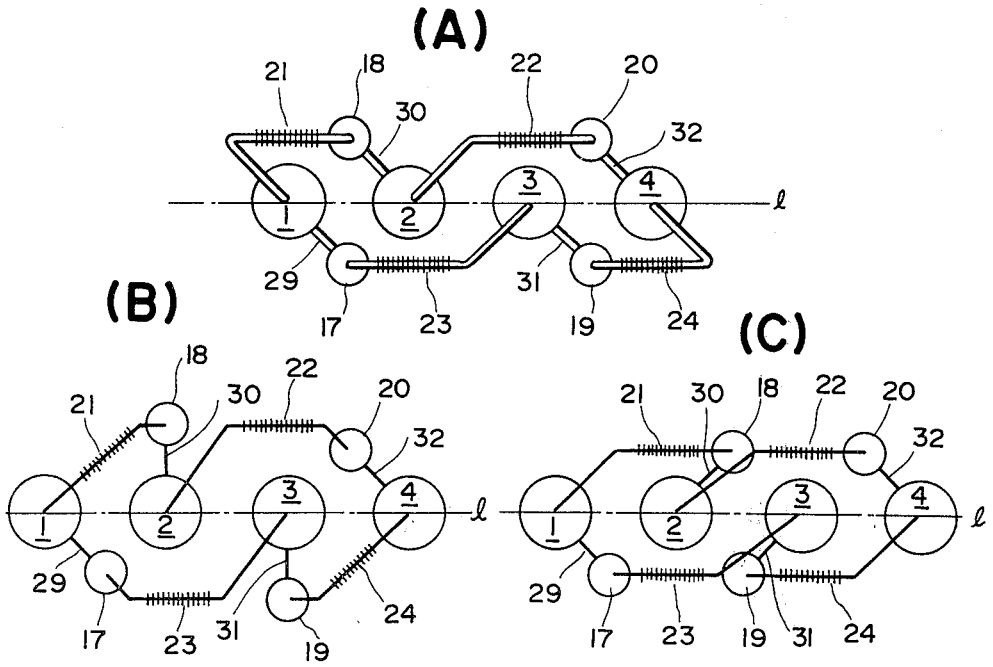
FIGS. 5(A), (B) and (C) are three diagrammatic top views showing the basic arrangement of the closed cycle in-line double acting hot gas engine according to the present invention.

FIG. 4 is a diagrammatic view showing a typical prior-art in-line four-cylinder double-acting hot gas engine. The cylinders are arranged from the left in the order of the first cylinder 1, the second cylinder 2, the third cylinder 3, and the fourth cylinder 4. The respective regenerator/coolers are arranged from the left in the order of the first regenerator/cooler 17, the second regenerator/cooler 18, the third regenerator/cooler 19, and the fourth regenerator/cooler 20. The expansion spaces of the first, the second, the third, and the fourth cylinders 1, 2, 3 and 4, respectively, are connected to the regenerator sides of the first, the second, the third, and the fourth regenerator/coolers 17, 18, 19 and 20, respectively, through the first, the second, the third, and the fourth heaters 21, 22, 23 and 24, respectively. The compression spaces of the first, the second, the third, and the fourth cylinders 1, 2, 3 and 4, respectively, are connected to the cooler sides of the third, the first, the fourth, and the second regenerator/coolers 19, 17, 20 and 18, respectively, through the first, the second, the third, and the fourth low-temperature ducts 29, 30, 31 and 32, respectively. In this construction, the engine operates in the order of the first, the third, the fourth and the second cylinders 1, 3, 4 and 2 respectively.

In the prior-art hot gas engine thus constructed, although the heaters 21, 22, 23 and 24 are the same length, since the low-temperature ducts are not the same length, the dead volumes in the low-temperature sides and their pressure losses are not uniform between the cylinders, thus resulting in a generation of vibration and in a lack of uniformity of the respective cylinder outputs. Especially, the engine output is greatly reduced since the dead volumes of the low-temperature sides are excessively large at the first low-temperature duct 29 and the fourth low-temperature duct 32.

Further, in this construction, since the heaters 21–24 are arranged in a straight line parallel to the crankshaft, it is difficult to heat the heaters uniformly by using a single burner. Therefore, it is necessary to provide a burner for each heater or to arrange a burner between each pair of heaters, that is, three or four burners are required, resulting in a complicated structure including the control system and thus a high-priced engine.

To overcome these problems, it is necessary to make the in-line double-acting high-performance hot gas engine simple in structure and less prone to vibration such that the regenerator/coolers connected to the compression spaces of the first and the third cylinders 1 and 3 and the regenerator/coolers connected to the compression spaces of the second and the fourth cylinders 2 and 4 are arranged separately on each side symmetrically with respect to the cylinder line the same distance away from the line, all the low temperature gas passageways are short and the same in length, all the dead volumes on the low temperature side between the cylinders are the same, the pressure losses are small, only one or two burners are required, and the engine operates in the order of the first, the third, the fourth, and the second cylinders.

It is another object of the present invention to provide a novel structure of the in-line double-acting hot gas engine which can further reduce the dead volume and the pressure loss in the low-temperature side ducts by arranging each regenerator/cooler around the respective cylinder in a concentric annular shape to virtually eliminate the low-temperature side ducts.

In view of the above description, reference is now made to FIGS. 5–14 to describe the preferred embodiments according to the present invention in more detail.

FIG. 5(A) is a diagrammatic plan view showing the basic structure of a in-line hot gas engine according to the present invention.

In this embodiment, the first, the second, the third, and the fourth cylinders 1, 2, 3 and 4 respectively are arranged in series along the crankshaft (not shown), and the heaters 21, 22, 23 and 24 respectively and the regenerator/coolers 17, 18, 19 and 20 respectively are so connected that the engine operates in the order of the first, the third, the fourth, and the second cylinders 1, 3, 4 and 2, respectively. The first and the third regenerator/coolers 17 and 19, respectively, and the second and fourth regenerator/coolers 18 and 20, respectively, are arranged on opposite sides to each other with respect to the cylinder line (the central line l of the crankshaft). By arranging the cylinders in this way, it is possible to arranged for uniformly-long low temperature ducts 29, 30, 31 and 32 between the compression spaces of the respective cylinder 1–4 and the respective regenerator/coolers 17–20.

FIGS. 5(B) and (C) are basically the same as FIG. 5(A), where the second and the third regenerator/coolers 18 and 19, respectively, are disposed at positions different from the ones shown in FIG. 5(A), while the low temperature ducts 29, 30, 31 and 32 are the same.

In the arrangement thus constructed, there are some cases where the lengths of the high temperature gas passageways (the heaters and the high temperature ducts) are not all the same. Although it is possible to make the lengths uniform by introducing bends in the shorter passageway, since differences in dead volume in the high temperature parts is not serious but differences in dead volume between the low temperature parts is relatively serious due to the high gas density, it is desirable to make the outputs of the respective cylinders uniform by matching the lengths of the low temperature gas passageways with each other.

Figure 6A:
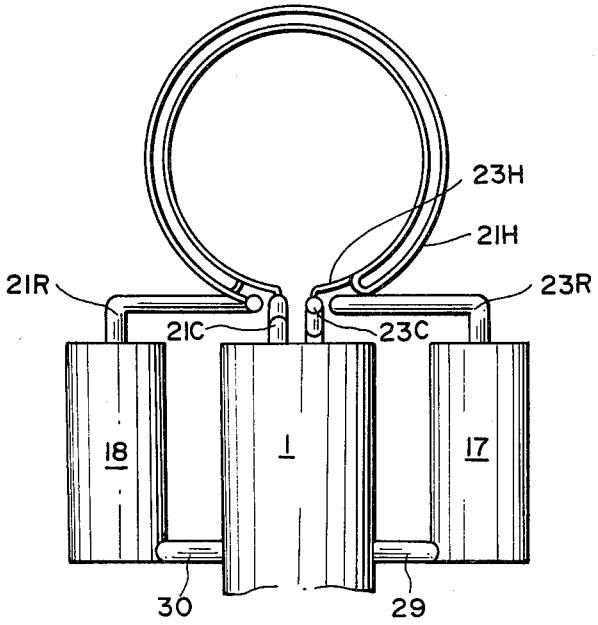
FIG. 6(A) is a diagrammatic front view of a first embodiment of the high-temperature gas passageways (the heater head) of the hot gas engine according to the present invention.
Figure 6B:
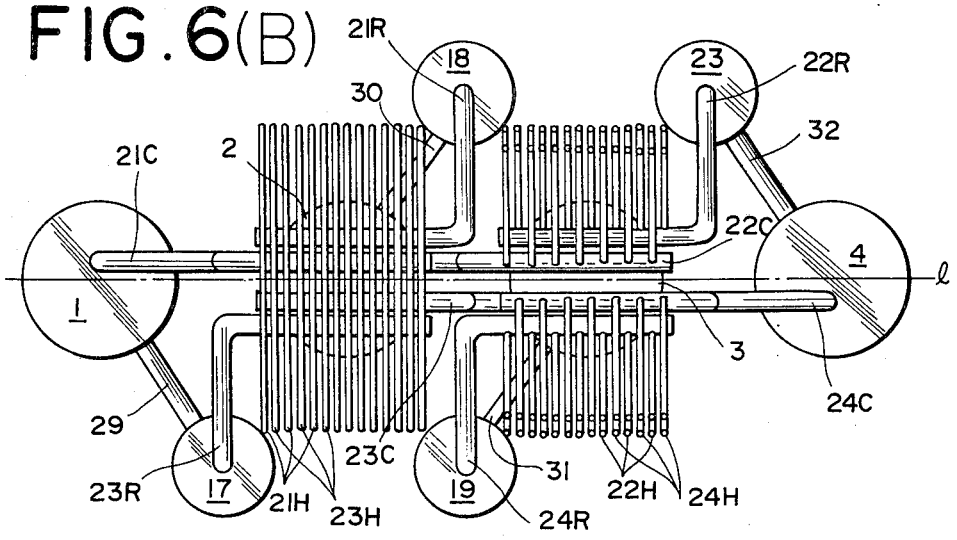
FIG. 6(B) is a diagrammatic top view of FIG. 6(A)
Figure 6C:
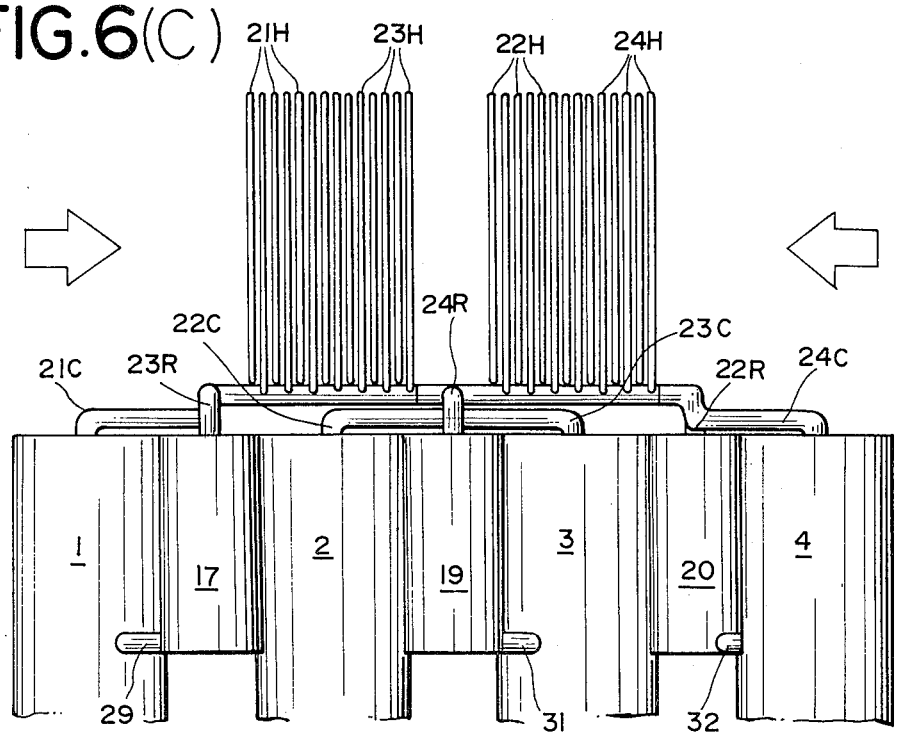
FIG. 6(C) is a diagrammatic side view of FIG. 6(A)

Next, the actual structure of a first embodiment of the high temperature gas passageways are shown in FIGS. 6(A), (B) and (C), where FIG. 6(A) is a diagrammatic front view thereof, FIG. 6(B) is a diagrammatic top view thereof, and FIG. 6(C) is a diagrammatic side view thereof.

In these figures, the high temperature gas passageways are made up of cylinder side ducts 21c–24c, heater tubes 21H–24H and regenerator side ducts 21R–24R, where the heater tubes 21H–24H are circular multiple-tube heat exchangers in which a plurality of tubes are arranged parallel to each other so as to form a cylindrical heat exchanger.

To explain the structure of the first and the third heaters 21 and 23, respectively, in more detail, the length of the cylinder side duct 21c connected to the top of the first cylinder 1 is equal to that of the cylinder side duct 23c connected to the top of the third cylinder 3 and these ducts 21c and 23c are disposed symmetrically with respect to the center line l of the crankshaft, as depicted in FIG 6(B).

As shown in FIG. 6(A), the heater tubes 21H and 23H are concentrically-formed circular U-shaped tubes, the lengths of which are equal to each other, being arranged alternately in opposite directions.

Half of the inner ends of the circular tubes 21H and 23H are connected to the cylinder side ducts 21c and 23c, respectively. Half of the outer ends of the total circular tubes 21H and 23H are connected to the regenerator/cooler side ducts 21R, and 23R respectively. In the case of a heater tube 21H the inner end of which is connected to the duct 21c of the first cylinder 1, the outer end thereof is connected to the regenerator side duct 21R connected to the second regenerator/cooler 18; in the case of a heater tube 23H the inner end of which is connected to the duct 23c of the third cylinder 3, the outer end thereof is connected to the first regenerator side duct 23R connected to the first regenerator/cooler 17.

The lengths of the regenerator side ducts 21R and 23R are equal to each other having their respective parts parallel to the center line 1 of the crankshaft, and the parallel parts are arranged the same distance away from the respective cylinder side ducts 21c and 23c with respect to the center line of the crankshaft.

Since the structures of the fourth and the second heaters 24 and 22, respectively, are the same as described above, the description thereof is omitted herein.

In this embodiment of the in-line hot gas engine according to the present invention, since the regenerator/coolers are arranged by and between the respective cylinders, and since the horizontal center line of the respective heater tubes coincides with the line of the second and the third cylinders, it is possible to make the lengths of the high temperature gas passageways uniform.

In the in-line double-acting hot gas engine thus constructed, however, since the heater tube groups are disposed independently at two different places, two burners are required and the structure including the control system is complicated, the cost is relatively high, and there is a problem in that it is difficult to heat both heater tube groups uniformly.

It is another object of the present invention to provide a in-line double-acting hot gas engine in which four pairs of approximately quadrant shaped manifolds are disposed over the engine so as to form two sets of concentric inner-and-outer circular shapes, the heaters are simple in structure, and both heater tube groups are heated uniformly.

With reference to FIGS. 7–10, there is explained four embodiments of the heater head according to the present invention.

Figure 7A:
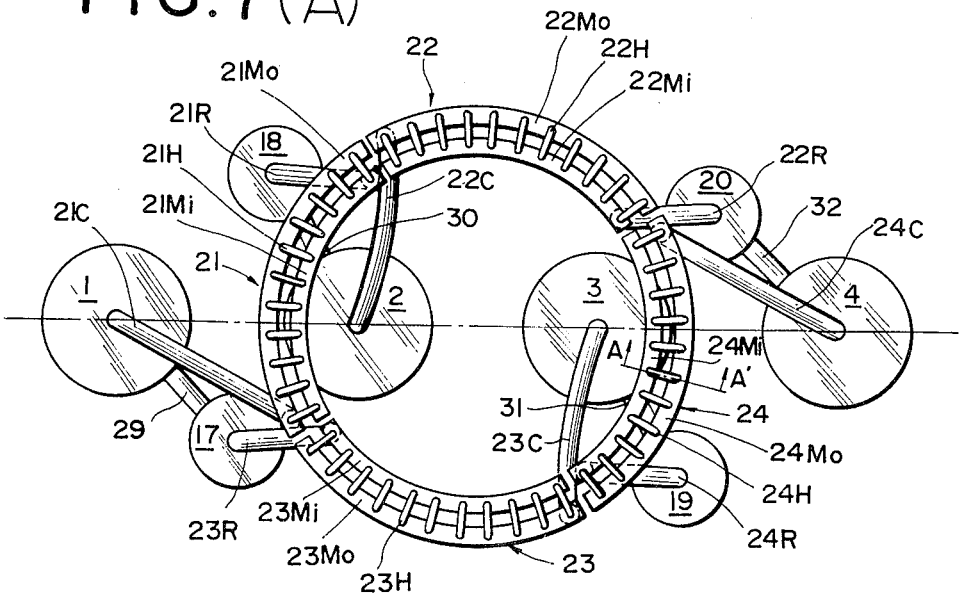
FIG. 7(A) is a diagrammatic top view of a second embodiment of the high-temperature gas passageways of the hot gas engine according to the present invention.
Figure 7B:
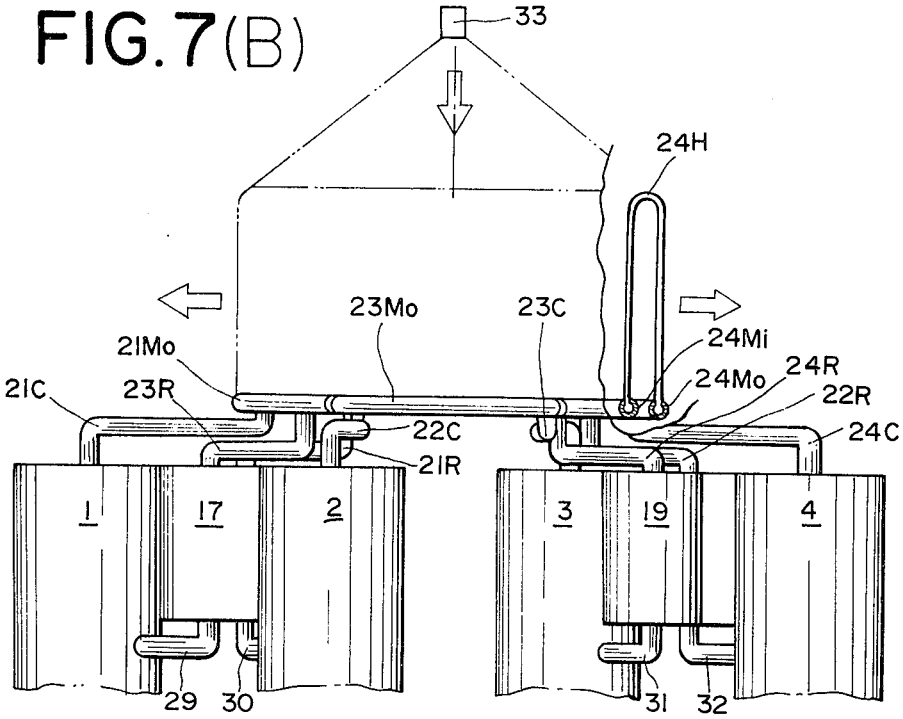
FIG. 7(B) is a diagrammatic side view of FIG. 7(A), including a fragmentary cross-sectional view of a heater tube taken along the lines A—A' in FIG. 7(A)
Figure 7C:
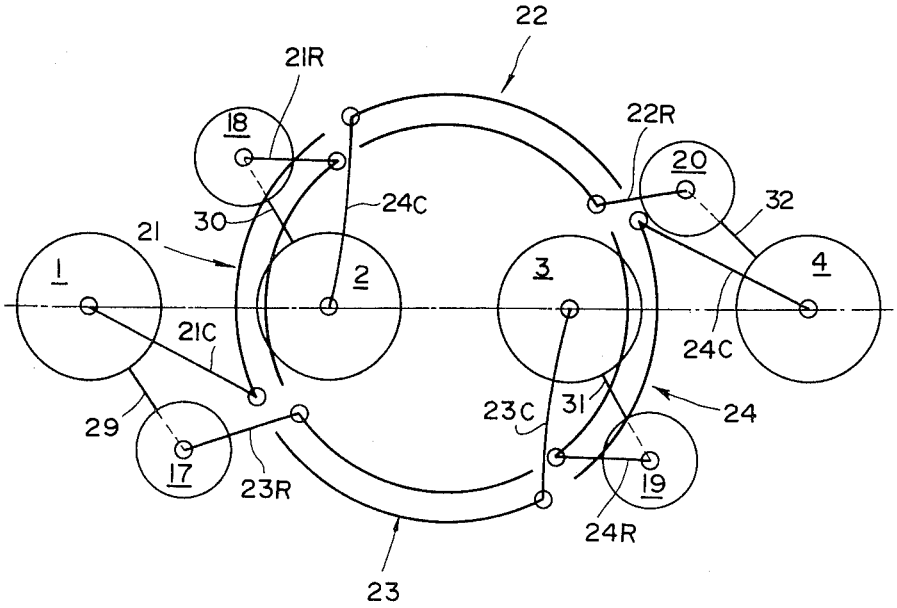
FIG. 7(C) is a skeletonal plan according to FIG. 7(A)

FIGS. 7(A), (B) and (C) show a second embodiment of the heater head according to the present invention, where FIG. 7(A) is a diagrammatic plan view thereof, FIG. 7(B) is a diagrammatic side view thereof, and FIG. 7(C) is a skeletonal plan thereof, respectively.

In these figures, four pairs (a pair of tubes includes an inner tube and an outer tube) of quadrant shaped concentrically-arranged inner manifolds 21Mi–24Mi and outer manifolds 21Mo–24Mo, respectively, are disposed with their centers positioned at the middle of the engine. One end of each of the four inner manifolds 21Mi–24Mi is connected to the respective regenerator side duct 21R–24R; the opposite end of each of the four outer manifolds 21Mo–24Mo is connected to the cylinder side duct 21c–24c, respectively, and a plurality of long inverted U-shaped radially-arranged heater tubes 21H–24H are connected between the four pairs of inner and outer manifolds, so as to form a cylindrical heat exchanger with the first, the second, the third, and the fourth heaters 21–24 respectively.

All the regenerator side ducts 21R–24R are designed to be equal to each other in length and further to be as short as possible. The second and the third cylinder side ducts 22c and 23c are bent a little to avoid interference with the third and the second regenerator side ducts 21R and 24R, respectively. Therefore, the curved lengths of the above-mentioned second and third cylinder side ducts 22c and 23c are slightly different from the straight lengths of the first and the third cylinder side ducts 21c and 24c.

In addition, a burner nozzle 33 is disposed at the center top of the cylindrical heaters.

In the heater tubes thus constructed, since the pairs of the inner and outer manifolds 21Mi–24Mi and 21Mo–24Mo are connected to the regenerator side ducts 21R–24R or the cylinder side ducts 21c–24c, respectively, at ends opposite to each other, the flow of the gas is made uniform while the working gas is passed reciprocatedly within the respective heater tubes 21H–24H.

That is, when the working gas flows from the cylinder side through the heater tubes 21H–24H, a large amount of gas flows into the heater tubes 21H–24H near the cylinder side ducts 21c–24c. Similarly, when the working gas flows from the regenerator side through the heater tubes 21H–24H, the same large amount of gas flows into the heater tubes 21H–24H near the regenerator side ducts 21R–24R. Therefore, the flow of the gas is uniform whichever way the gas flows through the heater tubes.

Further, since all the high-temperature gas passageways between the cylinders and the respective regenerators are equal in length to each other and since the heater tubes connected to the respective cylinders are disposed cylindrically, it is possible to heat the heater tubes uniformly by using only one burner.

Further, in this embodiment, it is possible to arrange the burner at the central lower part of the cylindrical heater, in place of the central top part thereof.

Figure 8A:
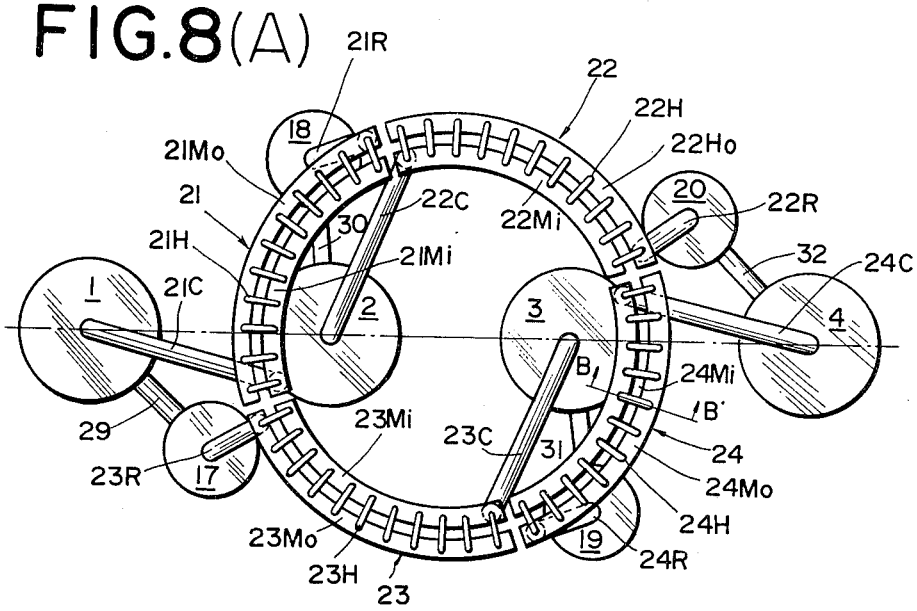
FIG. 8(A) is a diagrammatic top view of a third embodiment of the high-temperature gas passageways of the hot gas engine according to the present invention.
Figure 8B:
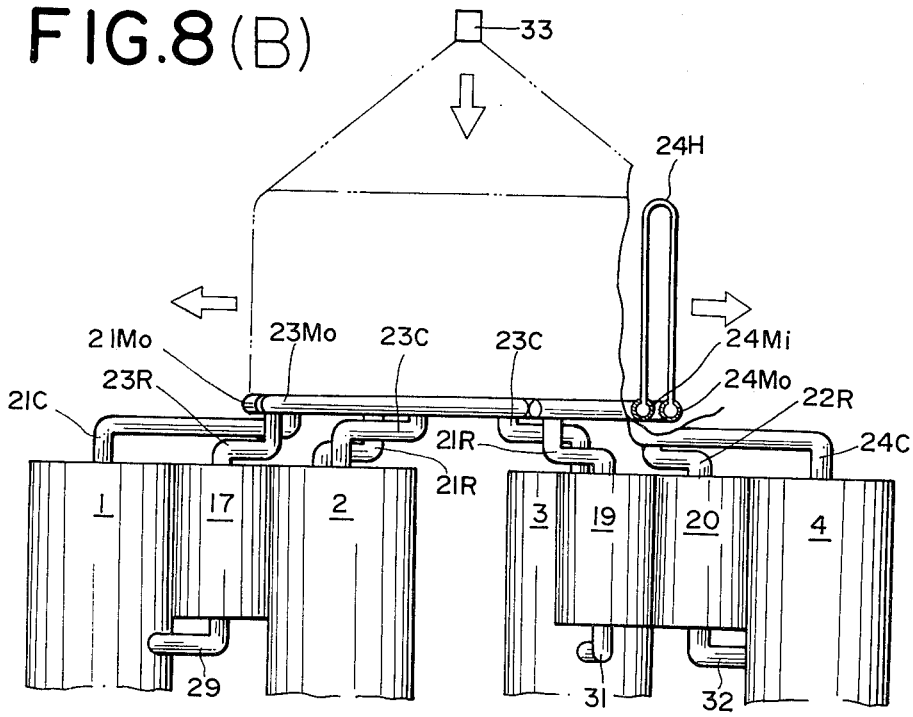
FIG. 8(B) is a diagrammatic side plan view of FIG. 8(A), including a fragmentary cross-sectional view of a heater tubes taken along the lines B—B' in FIG. 8(A)
Figure 8C:
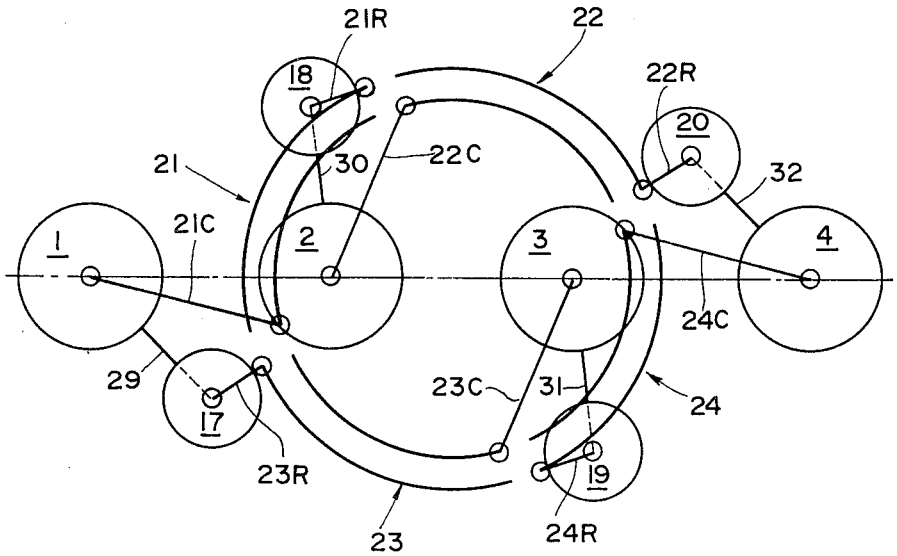
FIG. 8(C) is a skeletonal plan according to FIG. 8(A)

FIGS. 8(A), (B) and (C) show a third embodiment of the heater head according to the present invention, in which a minor change is achieved from the second embodiment, where FIG. 8(A) is a diagrammatic top view thereof, FIG. 8(B) is a diagrammatic side view thereof, and FIG. 7(C) is a skeletonal plan thereof, respectively.

In this embodiment, the cylinder side ducts 21c–24c are connected to the inner manifolds 21Mi–24Mi and the regenerator side ducts 21R–24R are connected to the outer manifolds 21Mo–24Mo, respectively.

In this case, it is possible to avoid interference between the ducts, to make the lengths of the cylinder side ducts 21c–24c and the regenerator side ducts 21R–24R equal, and to shorten the total lengths of the respective ducts.

Figure 9A:
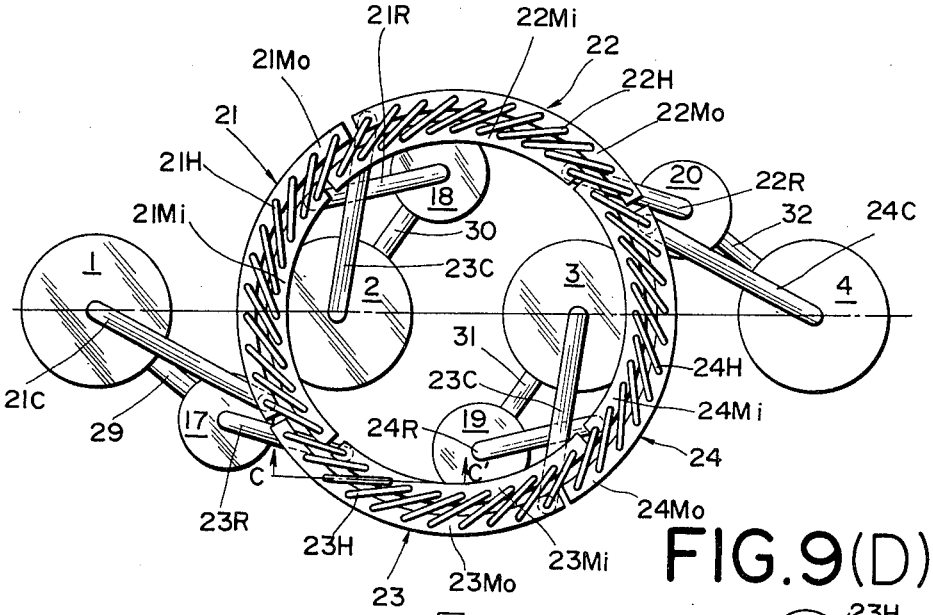
FIG. 9(A) is a diagrammatic top view of a fourth embodiment of the high-temperature gas passageways of the hot gas engine according to the present invention.
Figure 9D:
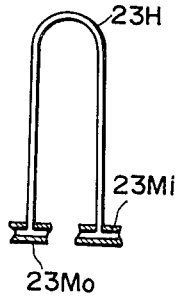
FIG. 9(D) is a side view of a long inverted U-shaped radially-arranged hot tube.
Figure 9B:
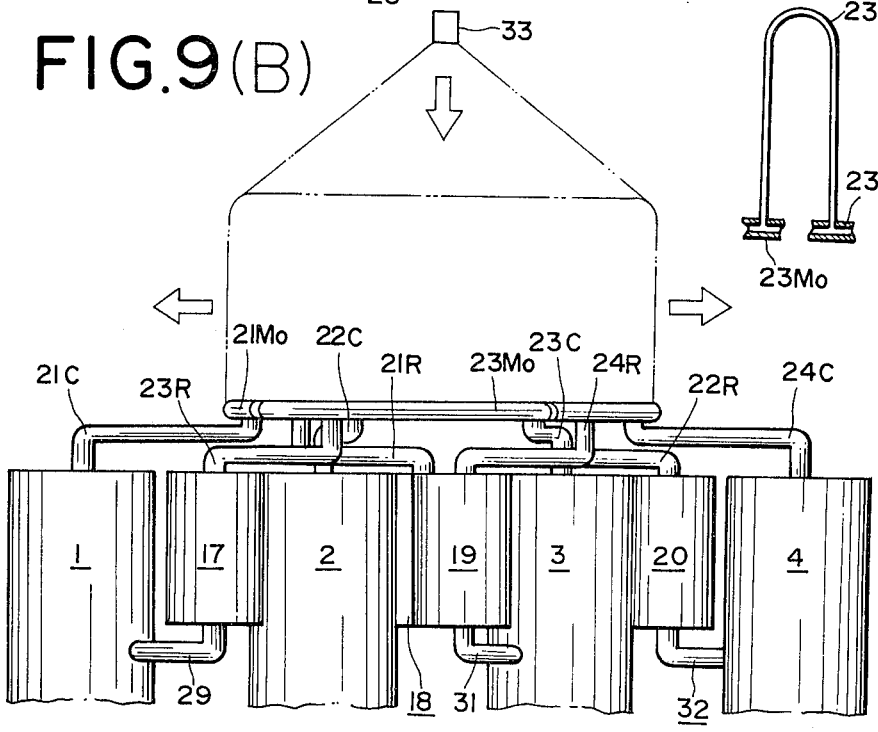
Figure 9C:
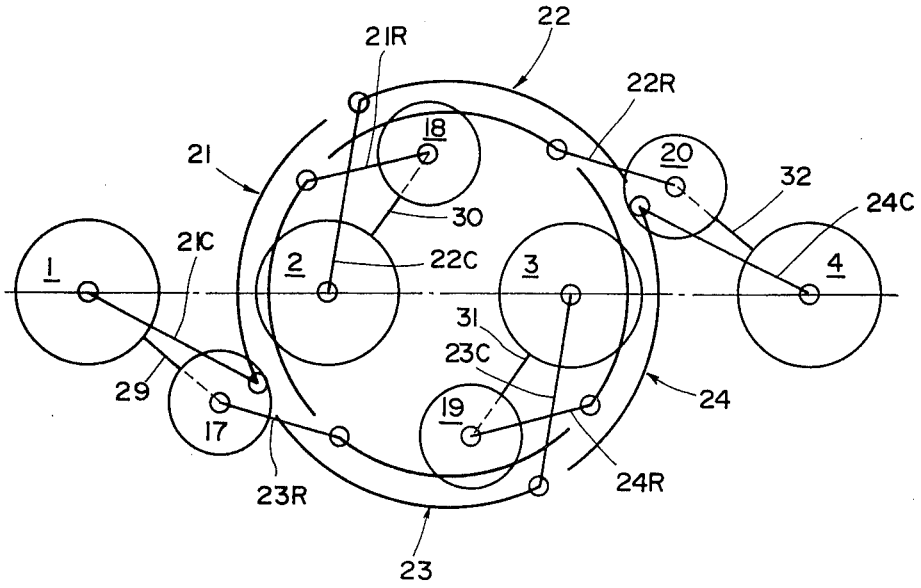
FIG. 9(C) is a skeletonal plan according to FIG. 9(A)
Figure 10A:
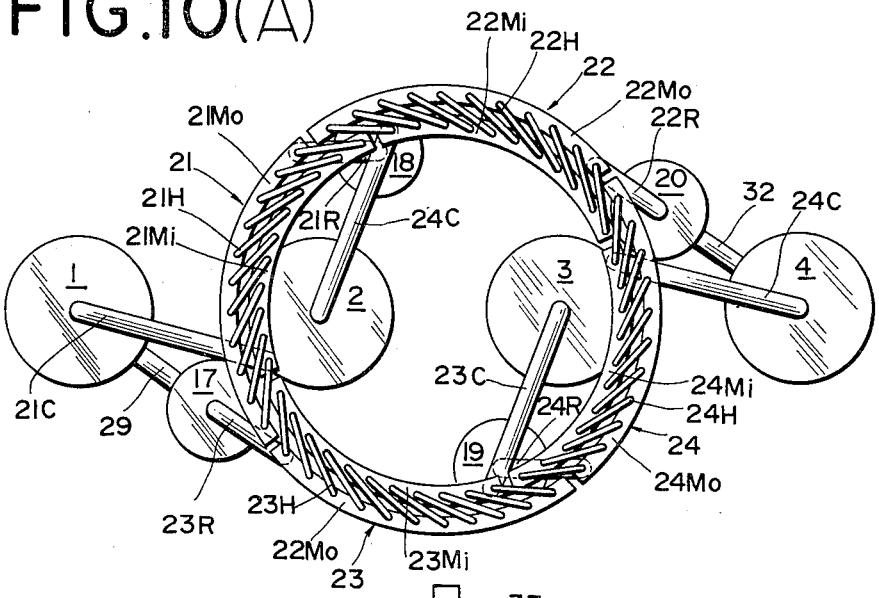
FIG. 10(A) is a diagrammatic top view of a fifth embodiment of the high-temperature gas passageways of the hot gas engine according to the present invention.
Figure 10B:
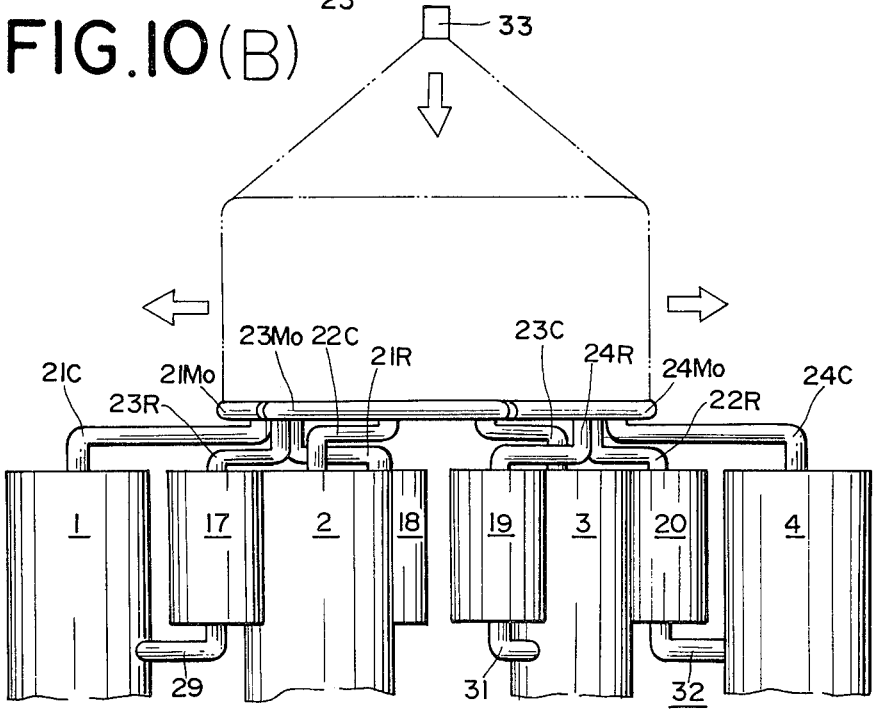
FIG. 10(B) is a diagrammatic side view of FIG. 10(A)
Figure 10C:
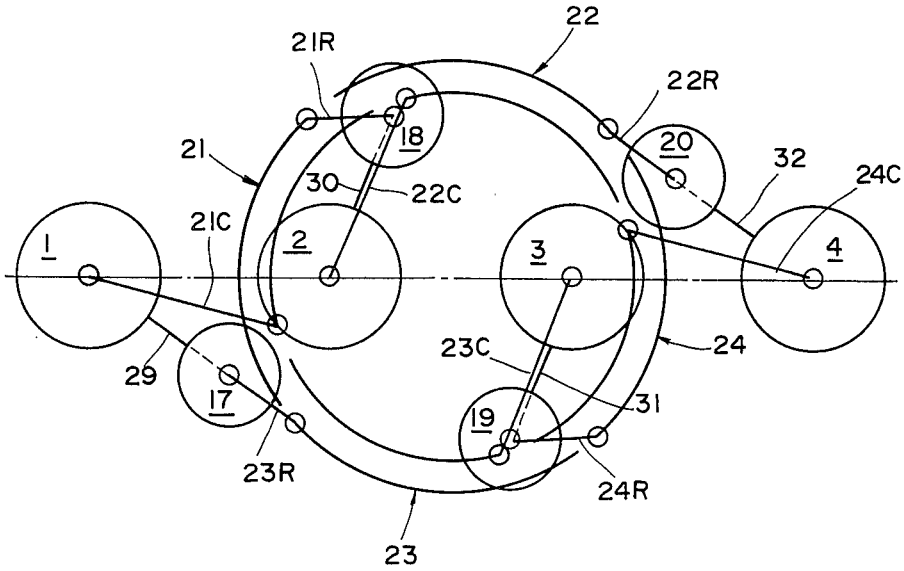
FIG. 10(C) is a skeletonal plan according to FIG. 10(A)

FIGS. 9(A), (B) and (C) and FIGS. 10(A), (B) and (C) show a fourth and a fifth embodiment, respectively, according to the present invention, in which the inner manifolds are shifted a small distance in the circumferential direction thereof with respect to the outer manifolds. In the fourth embodiment of FIGS. 9(A), (B) and (C), the regenerator side ducts 21R–24R are connected to the inner manifolds 21Mi–24Mi, respectively; in the fifth embodiment of FIGS. 10(A), (B) and (C), the cylinder side ducts 21c–24c are connected to the inner manifolds 21Mi–24Mi, respectively. In these embodiments, the ducts are equal to each other in length.

Among the above-mentioned four embodiments, it is possible to select an optimum embodiment in which the high-temperature gas passageways are equal in their minimum length, according to the dimensions of the cylinder diameter, the regenerator diameter, the cylinder spacing, the annular heater diameter and so on.

Next, other embodiments of the closed cycle inline hot gas engine according to the present invention will be described hereinbelow, in which the dead volume or the pressure loss in the low-temperature side ducts can be reduced by arranging the respective regenerator/coolers around the cylinders concentrically and cylindrically with respect to the cylinders to virtually eliminate the low-temperature side ducts.

With reference to the accompanying drawings, these embodiments of the present invention are explained.

Figure 11A:
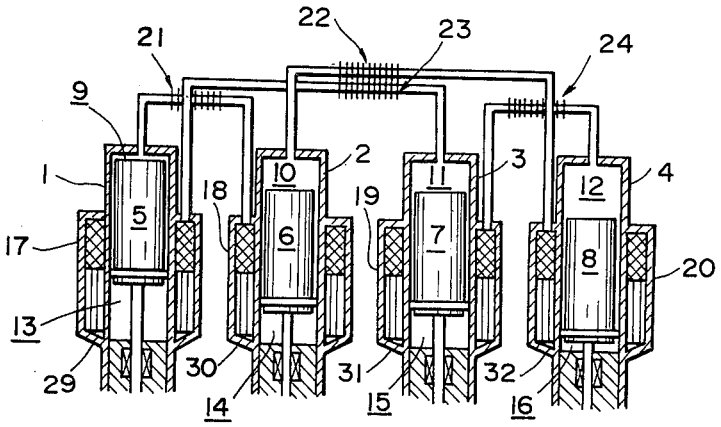
FIG. 11(A) is a basic diagrammatic cross-sectional view of a sixth embodiment of the hot gas engine according to the present invention, in which the regenerator/coolers are each arranged around the respective cylinders.
Figure 11B:
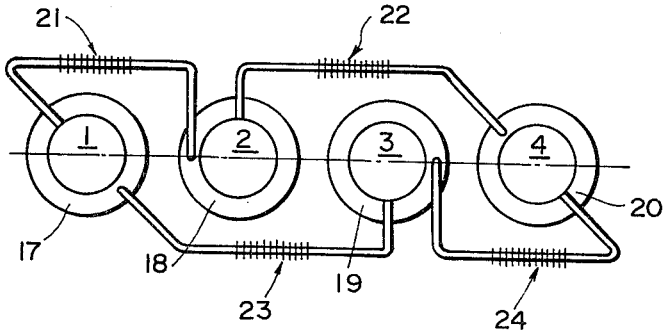
FIG. 11(B) is a basic diagrammatic top view of FIG. 11(A)

FIGS. 11(A) and (B) show a basic construction of the present invention, in which the driven mechanism including the crankshaft is omitted, where FIG. 11(A) is a diagrammatic side view thereof and FIG. 11(B) is a diagrammatic top view thereof.

In these figures, the first, the second, the third, and the fourth regenerator/coolers 17, 18, 19 and 20, respectively, are arranged around the first, the second, the third, and the fourth cylinders 1, 2, 3 and 4, respectively, as a concentric cylinder.

Here, the reference numerals 5, 6, 7 and 8 denote the respective pistons of the first, the second, the third and the fourth cylinders, numerals 9, 10, 11 and 12 denote the first, the second, the third, and the fourth expansion spaces respectively, numerals 13, 14, 15 and 16 denote the first, the second, the third, and the fourth compression spaces, respectively. The first, the second, the third, and the fourth expansion spaces 9, 10, 11 and 12, respectively, are connected to the regenerator sides of the second, the fourth, the first, and the third regenerator/coolers 18, 20, 17 and 19, respectively, through the first, the second, the third, and the fourth heaters 21, 22, 23 and 24, respectively. The first, the second, the third, and the fourth compression spaces 13, 14, 15 and 16, respectively, are connected to the cooler sides of the first, the second, the third and the fourth regenerator/coolers 17, 18, 19 and 20, respectively, through the holes 29, 30, 31 and 32, respectively, which replace the low-temperature ducts.

Accordingly, the first expansion space 9 over the first piston 5 is connected to the second compression space 14 under the second piston 6 through the first heater 21, the second regenerator/cooler 18, and the hole 30 to form a working space.

Similarly, the second expansion space 10 is connected to the fourth compression space 16; the third expansion space 11 is connected to the first compression space 13; the fourth expansion space 12 is connected to the third compression space 15. Further, in this case, the pistons 5–8 operate in succession at a constant phase shift of 90 degrees in crankshaft angle.

In the hot gas engine thus constructed, since the low-temperature side ducts are unnecessary, it is possible to reduce considerably the dead volume and the pressure loss at those parts, improving the performance of the hot gas engine.

Next, actual embodiments of the heater heads according to the present invention are described hereinbelow.

Figure 12A:
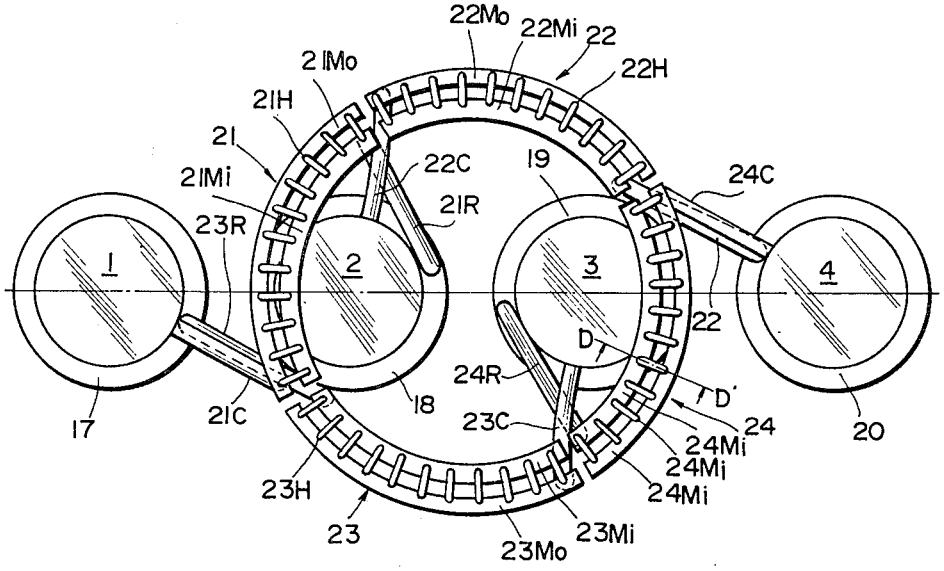
FIG. 12(A) is a diagrammatic top view of the sixth embodiment of the hot gas engine according to the present invention, in which the second embodiment of the high-temperature gas passageways of the hot gas engine shown in FIG. 7 is combined with the sixth basic embodiment of FIG. 11.
Figure 12B:
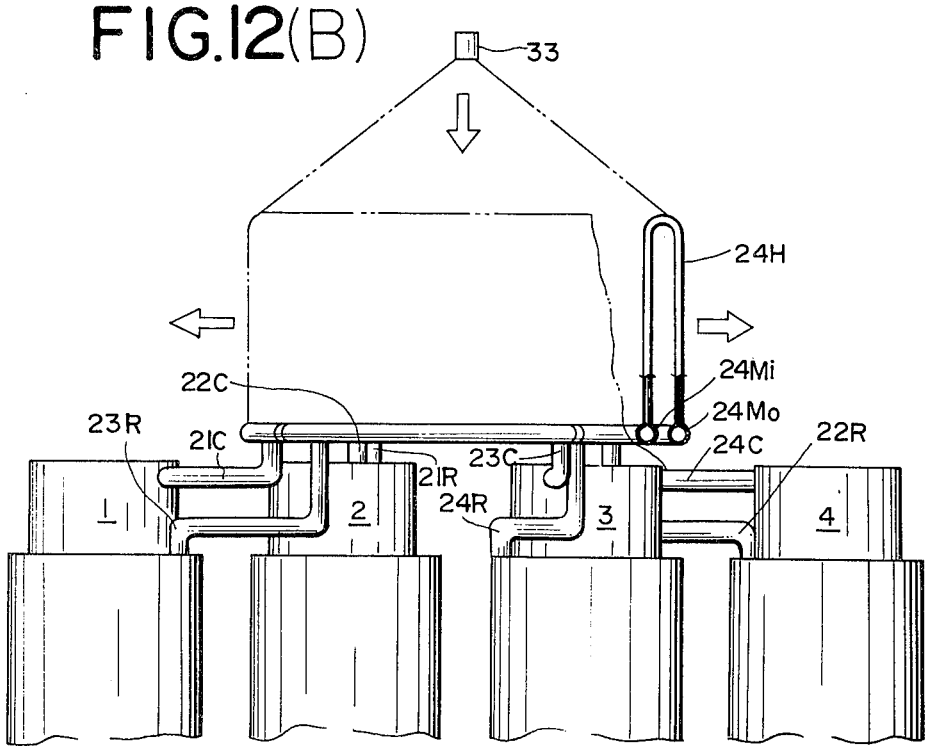
FIG. 12(B) is a diagrammatic side view of FIG. 12(A), including a fragmentary cross-sectional view of a heater tube taken along the lines D—D' in FIG. 12(A)

FIGS. 12(A) and (B) show a sixth embodiment of the heater head according to the present invention.

In these figures, four pairs (a pair of tubes includes an inner tube and an outer tube) of quadrant-shaped concentrically-arranged inner manifolds 21Mi–24Mi and outer manifolds 21Mo–24Mo are disposed with their centers at the engine center. One end of each of the four outer manifolds 21Mo–24Mo is connected to the cylinder side ducts 21c–24c, respectively; the opposite end of each of the four inner manifolds 21Mi–24Mi are connected to the regenerator side ducts 21R–24R, respectively, and a plurality of long inverted U-shaped radially-arranged heater tubes 21H–24H are connected between the four pairs of inner and outer manifolds, so as to form a heat exchanger with the first, the second, the third, and the fourth heaters 21–24 respectively gathered in cylindrical shape.

Further, all the regenerator side ducts 21R–24R are designed to be equal to each other in length and to be as short as possible. The second and the third cylinder side ducts 22c and 23c are bent a little to avoid interference with the third and the second regenerator side ducts 24R and 21R. Therefore, the curved lengths of the above-mentioned second and third cylinder side ducts 22c and 23c are slightly different from the straight lengths of the first and the fourth cylinder side ducts 21c and 24c.

In addition, a burner nozzle 33 is disposed at the center top of the annular heaters so that the combustion gas can flow in the direction of the arrow.

In the heater tubes thus constructed, since the respective pairs of inner and outer manifolds 21Mi–24Mi and 21Mo–24Mo are connected to the regenerator side ducts 21R–24R or the cylinder side ducts 21c–24c, respectively, at the ends opposite to each other, the flow of the gas is uniform when the working gas is passed in either direction through the heater tubes 21H–24H.

That is, when the working gas flows from the cylinder side to the heater tubes 21H–24H, a large amount of gas flows into the heater tubes 21H–24H arranged near the cylinder side ducts 21c–24c, respectively. In contrast to this, when the working gas flows from the regenerator side to the heater tubes 21H–24H, the same large amount of gas flows into the heater tubes 21H–24H arranged near the regenerator side ducts 21R–24R. Therefore, the flow of the gas is uniform whichever way the gas flows through the heater tubes reciprocatedly.

Further, since all the high-temperature gas passageways between the cylinders and the respective regenerators are equal in length to each other and since the heater tubes connected to the respective cylinders are disposed annularly, it is possible to heat the heater tubes uniformly by using only one burner.

Figure 13A:
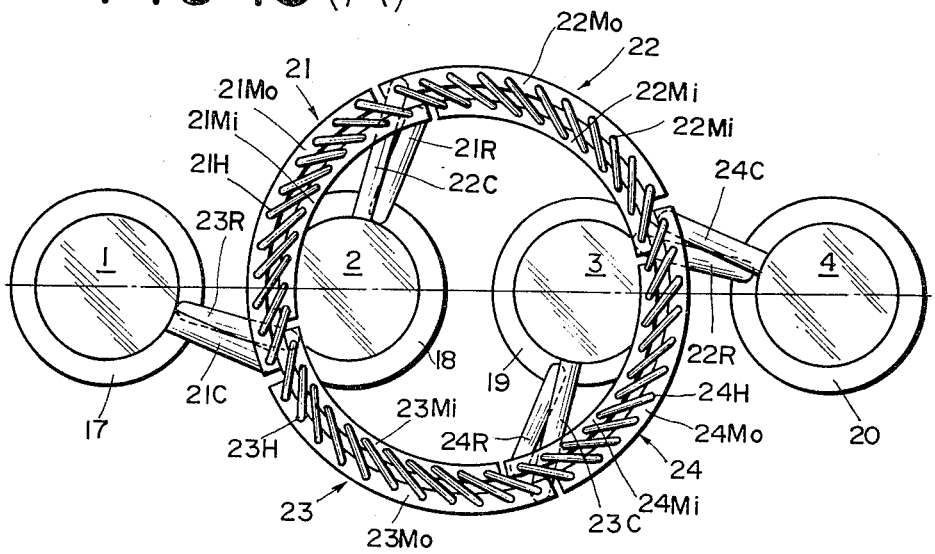
FIG. 13(A) is a diagrammatic top view of the seventh embodiment of the hot gas engine according to the present invention, in which the fourth embodiment of the high-temperature gas passageways of the hot gas engine shown in FIG. 9 is combined with the sixth basic embodiment of FIG. 13.
Figure 13B:
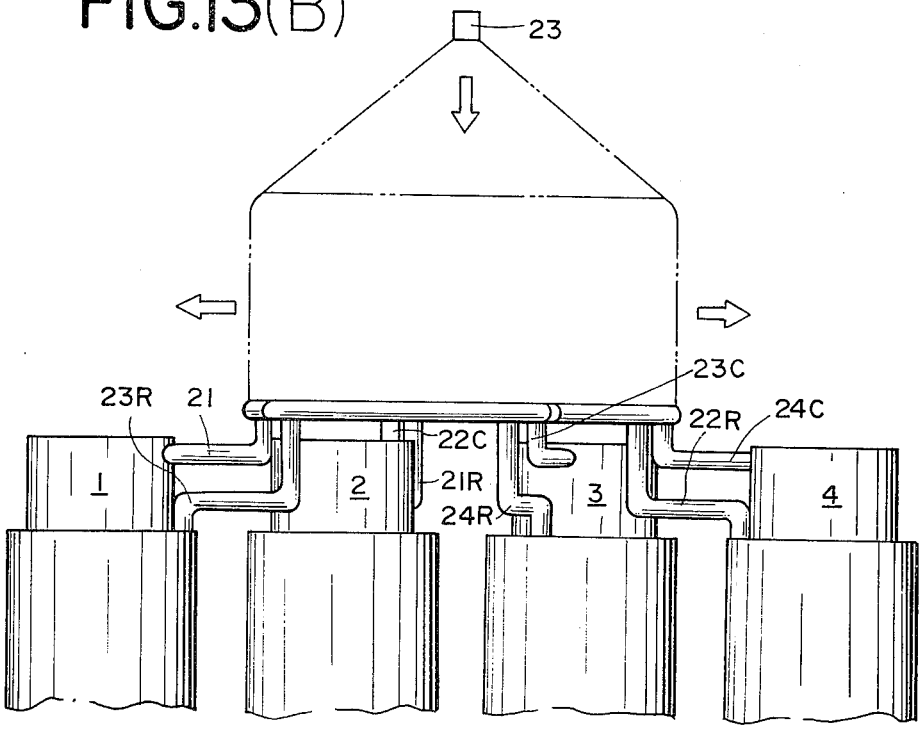
FIG. 13(B) is a diagrammatic side view of FIG. 13(A)

Next, FIGS. 13(A) and (B) show a seventh embodiment of the present invention, in which the inner and outer manifolds are shifted a small distance in the circumferential direction. In this embodiment, it is possible to make uniform and as short as possible the lengths of the cylinder side ducts 21*c*–24*c* and the regenerator side ducts 21R–24R.

Figure 14:
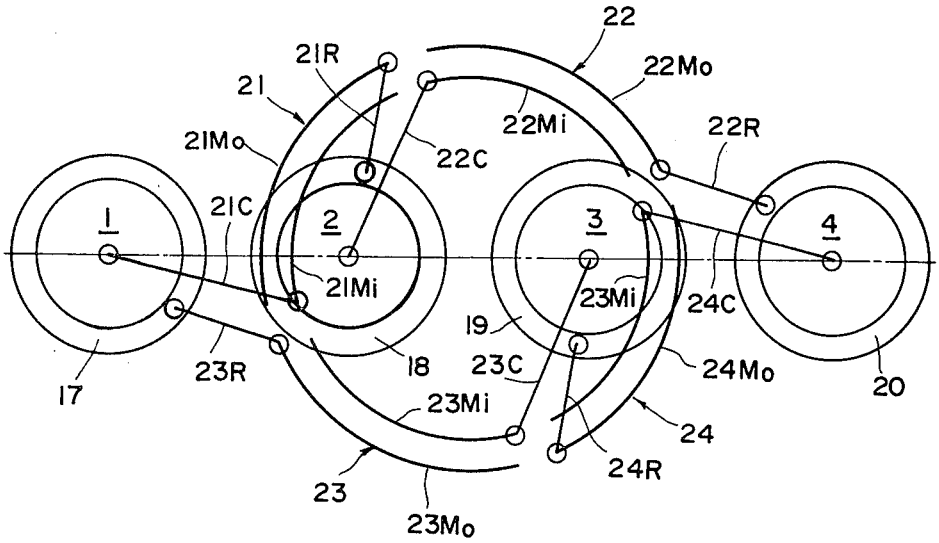
FIG. 14 is a skeletonal plan of the eighth embodiment of the hot gas engine according to the present invention, in which the fifth embodiment of the high-temperature gas passageways of the hot gas engine shown in FIG. 10 is combined with the sixth basic embodiment of FIG. 13.

Further, in any of the above-mentioned embodiments, the description has been made of the case where the inner manifolds 21Mi–24Mi are connected to the regenerator side ducts 21R–24R, respectively, and the outer manifolds 21Mo–24Mo are connected to the cylinder side ducts 21*c*–24*c*, respectively; however, it is possible to connect the inner manifolds 21Mi–24Mi to the cylinder side ducts 21*c*–24*c*, respectively, and the outer manifolds 21Mo–24Mo to the regenerator side ducts 21R–24R, respectively, as shown by the skeletonal plan of FIG. 14. In the case thus constructed, it is possible to make uniform the lengths of the cylinder side ducts 21*c*–24*c* and the regenerator side ducts 21R–24R, respectively, and thus the regenerator side ducts 21R–24R become very short.

As described hereinabove, in the in-line four-cylinder double-acting hot gas engine according to the present invention in which the cylinders are arranged in the order of the first, the second, the third and the fourth cylinders, since the engine operates in the order of the first, the third, the fourth and the second cylinders in the same manner as in the ordinary engine, it is possible to use a conventional crankshaft, to reduce the vibration of the engine considerably, and therefore to improve productivity without requiring special jigs and tools.

Further, since the regenerator/coolers are so arranged that the lengths of the respective low temperature gas passageways connected to the respective compression spaces of the cylinders are equal to each other, the dead volumes of the respective cylinder cooler ends are not excessive but are uniform, and therefore the engine output is improved without any vibration caused by mismatching of the respective cylinder outputs.

Furthermore, since the concentrically-arranged U-shaped heater tubes connecting each pair of cylinders are disposed in parallel to each other alternately, it is possible to heat the gas uniformly and to make the high temperature gas passageways equal, and therefore a uniform output is obtained from the respective cylinders and it is possible to supply a relatively low-priced high-performance engine by using only two burners.

Further, as described hereinabove, in the heater head of a in-line double-acting hot gas engine according to the present invention, since both the ends of the long inverted U-shaped heater tubes are connected to the annular heater tubes made of four pairs of quadrant-shaped inner and outer manifolds tubes so that the heater side ducts and the regenerator side ducts are each equal to each other in length, it is possible to heat the heaters connected to all the cylinders uniformly by using only one burner and to design a low-priced but high-performance hot gas engine.

In addition, when the heater side ducts and the regenerator side ducts are each designed to be equal to each other in their minimum length by shifting the position of the inner and outer manifolds tubes in the circumferential direction thereof, since the dead volume of the high temperature portion is reduced and the pressure loss is reduced when the working gas is reciprocated, it is possible to improve the performance of the hot gas engine.

Furthermore, as described hereinabove, in the in-line double-acting hot gas engine according to the present invention, since the regenerator/coolers are arranged around the respective cylinders as a concentric cylinder, and since the compression spaces are connected directly to the respective regenerator/coolers through holes without using low-temperature side ducts, and since the engine operates in the order of the first, the third, the fourth, and the second cylinders, it is possible to use an ordinary simple crankshaft in the same way as in an ordinary engine, to reduce vibration, and to obtain a high-performance hot gas engine in which the outputs from the cylinders are uniform.

It will be understood by those skilled in the art that the foregoing description is in terms of preferred embodiments of the present invention wherein various changes and modifications may be made without departing from the spirit and scope of the invention, as is set forth in the appended claims.

What is claimed is:

1. A closed cycle in-line double-acting hot gas engine, which comprises:

(a) four cylinders arranged in a straight line in the order of the first cylinder, the second cylinder, the third cylinder, and the fourth cylinder, said cylinders being operated in the order of the first cylinder, the third cylinder, the fourth cylinder, and the second cylinder;

(b) four regenerator/coolers arranged independently and symmetrically with respect to the cylinder line, the first regenerator/cooler, and the third regenerator/cooler being arranged on one side, the second regenerator/cooler and the fourth regenerator/cooler being arranged on the other side, said respective regenerator/coolers being connected to the respective compression spaces of said cylinders; and (c) four heaters arranged symmetrically with respect to the cylinder line, the first heater being connected between the first cylinder and the second regenerator/cooler, the second heater being connected between the second cylinder and the fourth regenerator/cooler, the fourth heater being connected between the fourth cylinder and the third regenerator/cooler, and the third heater being connected between the third cylinder and the first regenerator/cooler, said first heater and said third heater being both gathered so as to form a single cylindrical heat exchanger in such a way that a plurality of parallel arranged circular U-shaped heater tubes of said first heater and a plurality of parallel arranged circular U-shaped heater tubes of said third heater are disposed alternately as one group, and said second heater and said fourth heater being both gathered so as to form a single heat exchanger in such a way that a plurality of parallel arranged circular U-shaped heater tubes of said second heater and a plurality of parallel arranged circular U-shaped heater tubes of said fourth heater are disposed alternately as the other group, said two heaters being disposed over said cylinders horizontally and symmetrically with respect to the center line of said two cylindrical heaters.

2. A closed cycle in-line double-acting hot gas engine, which comprises:

(a) four cylinders arranged in a straight line in the order of the first cylinder, the second cylinder, the third cylinder, and the fourth cylinder, said cylinders being operated in the order of the first cylinder, the third cylinder, the fourth cylinder, and the second cylinder;

(b) four regenerator/coolers arranged independently and symmetrically with respect to the cylinder line, the first regenerator/cooler, and the third regenerator/cooler being arranged on one side, the second regenerator/cooler and the fourth regenerator/cooler being arranged on the other side, said respective regenerator/coolers being connected to the respective compression spaces of said cylinders; and (c) four heaters arranged symmetrically with respect to the cylinder line so as to form a single cylindrical heat exchanger in such a way that four pairs of approximately quadrant-shaped manifolds are disposed symmetrically over the engine in two sets of inner-and-outer concentric annular shapes, the two sets of inner-and-outer concentric annularly-shaped manifolds being connected by a plurality of long inverted U-shaped radially-arranged hot tubes so as to form a cylindrical shape, one end of each inner manifold being connected to the respective regenerator/coolers and the other end of each outer hot collection tube being connected to the respective expansion space of said cylinders.

3. A closed cycle in-line double-acting hot gas engine, which comprises:

(a) four cylinders arranged in a straight line in the order of the first cylinder, the second cylinder, the third cylinder, and the fourth cylinder, said cylinders being operated in the order of the first cylinder, the third cylinder, the fourth cylinder, and the second cylinder;

(b) four regenerator/coolers arranged independently and symmetrically with respect to the cylinder line, the first regenerator/cooler, and the third regenerator/cooler being arranged on one side, the second regenerator/cooler and the four regenerator/cooler being arranged on the other side, said respective regenerator/coolers being connected to the respective compression spaces of said cylinders; and (c) four heaters arranged symmetrically with respect to the cylinder line so as to form a single cylindrical heat exchanger in such a way that four pairs of approximately quadrant-shaped manifolds are disposed symmetrically over the engine in two sets of inner-and-outer concentric annular shapes, the two sets of inner-and-outer concentric annularly-shaped manifolds being connected by a plurality of long inverted U-shaped radially-arranged hot tubes so as to form a cylindrical shape, one end of each inner manifold being connected to the respective expansion space of said cylinders, and the other end of each outer manifold being connected to said respective regenerator/cooler.

4. A closed cylcle in-line double-acting hot gas engine as set forth in any of claims 1 to 3, which further comprises four low-temperature ducts connected between the respective compression spaces of said cylinders and said respective regenerator/coolers so as to form the same sized spaces.

5. A closed cycle in-line double-acting hot gas engine, which comprises:

(a) four cylinders arranged in a straight line in the order of the first cylinder, the second cylinder, the third cylinder and the fourth cylinder, said cylinders being operated in the order of the first cylinder, the third cylinder, the fourth cylinder and the second cylinder;

(b) four regenerator/coolers disposed around said four cylinders concentrically and cylindrically with respect to said cylinders in order to eliminate the low-temperature ducts, said regenerator/coolers being connected to the compression spaces of said cylinders through holes; and (c) four heaters arranged symmetrically with respect to the cylinder line so as to form a single cylindrical heat exchanger in such a way that four pairs of approximately quadrant-shaped manifolds are disposed symmetrically over the engine in two sets of inner-and-outer concentric annular shapes, the two sets of inner-and-outer concentric annularly-shaped manifolds being connected by a plurality of long inverted U-shaped radially-arranged hot tubes so as to form a cylindrical shape, one end of each inner manifold being connected to the respective regenerator/coolers and the other end of each outer hot collection tube being connected to the respective expansion space of said cylinders.

6. A closed cycle in-line double-acting hot gas engine, which comprises:

(a) four cylinders arranged in a straight line in the order of the first cylinder, the second cylinder, the third cylinder and the fourth cylinder, said cylinders being operated in the order of the first cylinder, the third cylinder, the fourth cylinder and the second cylinder, (b) four regenerator/coolers disposed around said fourth cylinders concentrically and cylindrically with respect to said cylinders in order to eliminate the low-temperature ducts, said regenerator/coolers being connected to the compression spaces of said cylinders through holes; and (c) four heaters arranged symmetrically with respect to the cylinder line so as to form a single cylindrical heat exchanger in such a way that four pairs of approximately quadrant-shaped manifolds are disposed symmetrically over the engine in two sets of inner-and-outer concentric annular shapes, the two sets of inner-and-outer concentric annularly-shaped manifolds being connected by a plurality of long inverted U-shaped radially-arranged hot tubes so as to form a cylindrical shape, one end of each inner manifold being connected to the respective expansion space of said cylinders, and the other end of each outer manifold being connected to said respective regenerator/cooler.

7. A closed cycle in-line double-acting hot gas engine as set forth in any of claims 2, 3, 5 and 6, wherein the inner annularly-shaped manifolds and the outer annularly manifolds are shifted a small distance from each other in the circumferential direction thereof to improve the efficiency in heat exchange.

* * * * *